US008596641B2

(12) United States Patent
Johnson

(10) Patent No.: US 8,596,641 B2
(45) Date of Patent: Dec. 3, 2013

(54) SPIN-IT BINGO MATH GAME

(76) Inventor: Vera Mae Johnson, Moss Point, MS (US)

( * ) Notice: Subject to any disclaimer, the term of this patent is extended or adjusted under 35 U.S.C. 154(b) by 21 days.

(21) Appl. No.: 13/169,851

(22) Filed: Jun. 27, 2011

(65) Prior Publication Data

US 2012/0003617 A1 Jan. 5, 2012

Related U.S. Application Data

(60) Provisional application No. 61/361,047, filed on Jul. 2, 2010.

(51) Int. Cl.
*A63F 3/00* (2006.01)

(52) U.S. Cl.
USPC ..... 273/269; 273/272; 273/142 R

(58) Field of Classification Search
USPC ..... 273/269, 272, 142 R
See application file for complete search history.

(56) References Cited

U.S. PATENT DOCUMENTS

| | | | | |
|---|---|---|---|---|
| 5,458,338 | A | 10/1995 | Beardsley | |
| 6,186,892 | B1 * | 2/2001 | Frank et al. | 463/19 |
| 2004/0242310 | A1 | 12/2004 | Perkins | |
| 2006/0080070 | A1 | 4/2006 | Flansburg | |
| 2006/0082059 | A1 * | 4/2006 | Lee | 273/236 |

* cited by examiner

*Primary Examiner* — Benjamin Layno
(74) *Attorney, Agent, or Firm* — Daniel Boudwin

(57) ABSTRACT

A kit for a mathematical equation and concept learning game based upon traditional Bingo. The kit includes a plurality of boards, each with a 5 by 5 matrix of squares filled with equations in each block of the matrix. A row above the matrix of squares includes the letters S, P, I, N and T above each respective column. Further included is a wheel divided into 100 segments, the first twenty segments marked as S1 through S20, the second twenty segments marked as P21 through P40, the third twenty segments marked as I41 through I60, the fourth twenty segments marked as N61 through N80 and finally the fifth twenty segments marked as T81 through T100. A method is provided to play the game by which the wheel is spun and a letter/number combination is called. Players cover squares of their matrix if the number called is an answer to a labeled equation in the called number and column. The first player to fill five squares horizontally, vertically or diagonally calls out "Spin-It" and wins the game.

4 Claims, 1 Drawing Sheet

12

| S | P | I | N | T |
|---|---|---|---|---|
| 50-40 | 40-14 | 50/11 | 72-9 | 50x2 |
| 100-99 | 11x3 | 9x5 | 88-17 | 99-8 |
| 20-14 | 7x3 | 18+26 | 84-4 | 70+13 |
| 8+5 | 37/1 | 58-10 | 9x7 | 1x87 |
| 15-8 | 48/2 | 8•6 | 10•7 | 9•9 |

14

12

| S | P | I | N | T |
|---|---|---|---|---|
| 50-40 | 40-14 | 50/11 | 72-9 | 50x2 |
| 100-99 | 11x3 | 9x5 | 88-17 | 99-8 |
| 20-14 | 7x3 | 18+26 | 84-4 | 70+13 |
| 8+5 | 37/1 | 58-10 | 9x7 | 1x87 |
| 15-8 | 48/2 | 8•6 | 10•7 | 9•9 |

14

SPIN-IT BINGO MATH GAME

CROSS REFERENCE TO RELATED APPLICATION

This application claims the benefit of U.S. Provisional Application No. 61/361,047 filed on Jul. 2, 2010, entitled "Spin-It Bingo."

BACKGROUND OF THE INVENTION

1. Field of the Invention

The present invention relates to a mathematical variation on a traditional Bingo game that encourages learning, mental stimulation, concentration and mathematical skills development in children.

There are many games designed to entertain and educate players. However, it can be difficult to find a game that is fun, competitive, challenging, and still remain educational in nature. Many parents prefer that their children play games that not only encourage fun, but also improve mental acuity, concentration, and learning.

The field of mathematics and math instruction is filled with various teaching devices, tools and games designed to assist students in the process of learning arithmetical concepts. The need to understand numbers and the concepts of numerical manipulation as well as the problem solving skills associated with applied math are critical skills in today's complex and technologically oriented society. Accordingly, the ability of a student to understand concepts relating to numbers and number theory is critical.

While the need for learning and employing math skills is well recognized, the ability to learn and apply mathematical concepts is not intuitive for many students. This is due, in part, to the inherent skills and ability of each student to learn, but it is also related in large part to the types of techniques and tools available for teaching. Typically, memorization and practice drills are employed to teach students math concepts. For example, many students have spent numerous hours memorizing multiplication tables, which can be onerous and boring for some. Similarly, some students at one time or another have resorted to flash cards in an attempt to learn math concepts and relationships.

While the previously employed tools and techniques for the study of mathematics are useful for certain students, other students are not able to make effective use of these existing tools and techniques. For example, some students are "visual" learners or "conceptual" learners and for these students, memorization is usually not an effective means of learning and understanding. For these students, early failed attempts at mathematical proficiency can be mere harbingers of future disappointment as they continue to use tools and techniques that are not in harmony with their particular learning style.

As can be seen by the discussion presented above, there is a need for additional and improved tools for teaching and explaining math concepts. Without the development of new and useful tools to enhance the study of math concepts beyond simple memorization, the ability to learn and understand certain math concepts and number relationships will continue to be suboptimal for many students of math. Lack of mathematical ability or a solid foundation thereof can lead to deficiencies later in the student's education, where these basic skills are expanded upon in more advanced techniques. Those who have no acquired the necessary mathematical skills will be at a disadvantage, or simply not capable of advancing in the field. Further, a proper foundation in the study of math and a joy of learning its techniques reduces the common complaint of boredom or disinterest when participating in mathematical exercises and class work later in the student's educational career.

Games offer a particular method of teaching that may appeal to students for which other means are ineffective. The game of Bingo is a popular game of chance played with randomly drawn numbers that players match against numbers that have been pre-printed on their respective matrices. The matrices may be printed on paper, card stock or electronically represented and are referred to as cards. Many versions conclude the game with the first person to achieve a specified pattern on their card from the drawn numbers. The winner is usually required to call out the word "Bingo!" to alert the other players and caller of a possible win. Potential wins are then checked for accuracy before confirmation, at which time the prize is secured and the game is concluded or reinitiated.

The present invention leverages a modified form of the traditional game of Bingo to assist in the learning of mathematical concepts. The present invention fills a need in the art by providing an entertaining, stimulating method of learning based upon a novel take on the traditional game of Bingo.

2. Description of the Prior Art

Several issued patents and published applications relate to the use of Bingo as a basis for educational games. However, none of these games provides a method for teaching and learning mathematical skills and concepts as provided by the present invention.

Some prior art devices focus on using Bingo as a trivia or question oriented game, allowing a person providing the correct answer to mark a location. Perkins U.S. Patent Publication No. 2004/0242310 is directed to a bingo-like game and method of playing. One variation is playable by one or more players and provides players with a chance to obtain prizes by responding to queries that correspond to the squares of a bingo board. The player who answers the question fills in a square. Completing a row, column, or optionally a diagonal, wins the game. This variation is playable as a television, board, or automated game (e.g., via computer or hand-held device). A second variation is playable using, for example, a slot machine, and includes random selection of results, such as via one or more slot reels. The Perkins application makes use of variation on the Bingo game for gambling and trivia activities. The Perkins invention does not address the need for an educational game or math related teaching method.

Flansburg U.S. Patent Publication No. 2006/0080070 is directed to a math matrix. The invention provides a 10 by 10 grid containing 100 cells with a different two-digit number contained in each cell of the grid. The numbers in the cells range from 00 to 99. In the most preferred embodiments of the present invention, a separate and distinct color is associated with each of the single digits 0 through 9. The math matrix is useful for both teaching and learning mathematical concepts and numerical relationships. Additional embodiments of the invention provide for various games for other applications of the math matrix as well. The Flansburg application provides a math game involving a matrix. However, the Flansburg application does not disclose an invention based on Bingo as provided by the present invention.

Other applications use similar methods to address spelling and grammar issues. Beardsley U.S. Pat. No. 5,458,338 is directed to a game for teaching grammar having a key card formed with a plurality of rows and columns, including columns with a heading across the top of the columns with letters to indicate a type for such column. The rows are marked with numbers. A different word or phrase is in each of the spaces in the rows and columns indicative of a part of speech and indicative of features of the English language with a plurality of calling cards, each includes a letter at the top indicative of one of the indicia letters across the top of the key card. Each calling card has a plurality of samples utilizing a particular feature of language and a question with regard to such samples and, in parentheses, the answer to the question. While the Beardsley application discloses a Bingo like game, the focus is not on mathematical concepts.

The aforementioned patents provide fresh takes on the game of Bingo, or likewise provide an educational version thereof. However, none of the prior art patents describe its use for teaching mathematical skills, or the method of game play described herein. Consequently there is a void in the prior art for mathematical learning methods involving games. In this regard, the present invention fulfills this need by providing a novel take on the traditional game of Bingo and employing a game to teach mathematical skills to children and adults.

SUMMARY OF THE INVENTION

In view of the foregoing disadvantages inherent in the known types of learning games now present in the prior art, the present invention provides a new take on a traditional Bingo games wherein the same can be utilized for providing convenience for the user when teaching or learning mathematical skills and concepts.

The present invention helps develop individual mental thinking ability, concentration, listening, and confidence in basic mathematical skills. The kit and method provide an entertaining yet challenging game that assists students in recognizing numbers and patterns. Individuals aged nine and older are the preferred audience to play the disclosed game. It offers a unique twist to the traditional game of Bingo. With this method, rather than simply calling a location on the card, a mathematical solution is called. This solution value is an answer to an equation located on one of the provided card squares. The player must find an equation with this value as an answer to a provided mathematical problem, and if found, mark the location. Players who fill rows, columns or diagonals may win the game. This method of teaching mathematical concepts encourages players to think quickly and to try multiple methods to obtain the correct answer.

It is therefore an object of the present invention to provide an entertaining and exciting method of learning mathematical concepts based on a variation of the traditional game of Bingo.

Another object of the present invention is to provide a kit with the necessary devices required to play such a game.

Yet another object of the present invention is to provide to further the mathematical learning and entertainment of children, and to provide a group game that inspires interest and excitement. Such games may be played in a classroom or in another capacity as a reward, or likewise as an activity to bolster mathematical thinking. In any situation, the game provides a means to facility mathematical concepts in the minds of children, preferably 9 years old and over. More difficult or less challenging versions may be provided for alternate ages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself, and manner in which it may be made and used, may be better understood by referring to the following description taken in connection with the accompanying drawings.

DETAILED DESCRIPTION OF THE INVENTION

Figures 1, 2:
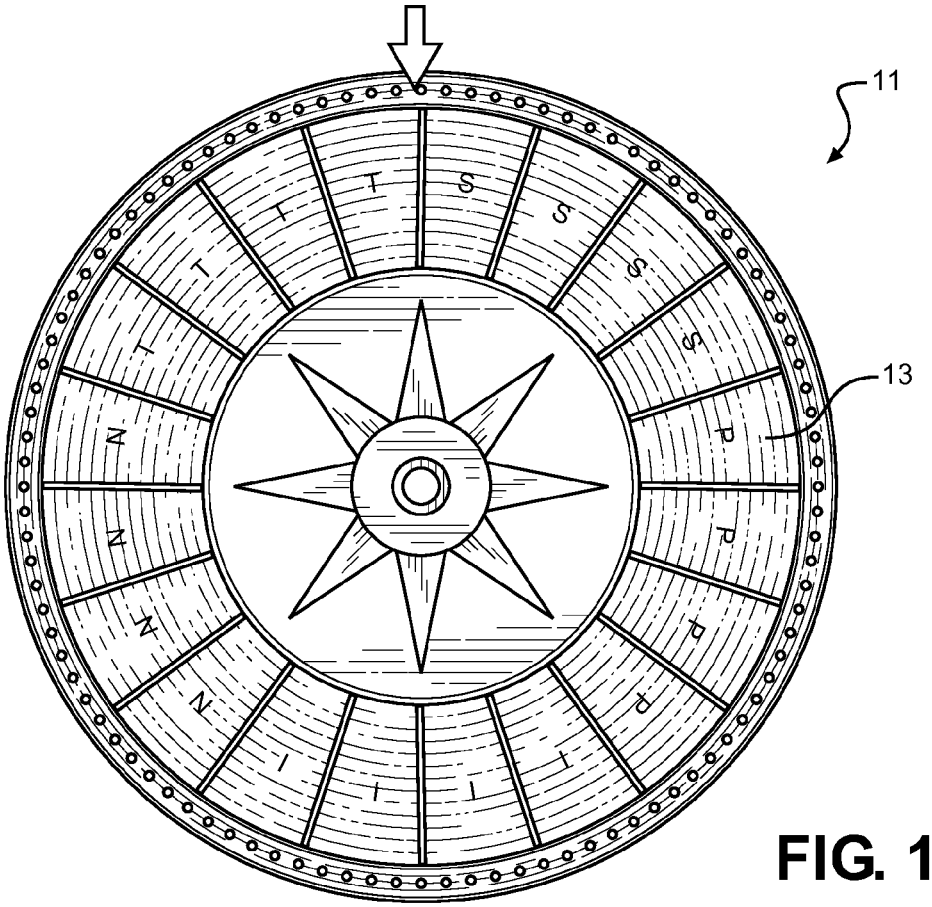
FIG. 1 is a view of a typical wheel that provides the number and letter combination for the game method and kit.
FIG. 2 is a view of a card matrix component of the game method and kit, which is supplied to each player and includes different equations and locations thereon between cards.

Referring now to FIG. 1, there is shown a view of a typical spin wheel that may be provided to determine the number and letter combination for the present game method and kit. The wheel 11 is divided into one hundred pie style segments 13. The segments 13 are labeled, S1 through S20, P21 through P40, I41 through I60, N61 through N80 and finally T81 through T100. To determine the next letter and number combination for each player to locate on their cards, the wheel is spun until the wheel settles on such a letter and number combination for that turn. It is not desired to limit the present invention to a particular type or style of spin wheel, particularly with regards to the design of the device, the spinning mechanism or the mechanism used to slow a spinning wheel. Any style wheel that can be spun, or includes a spinning element that allows random selection of a letter and number combination may be incorporated. Further, its ornamental design, color or features are not critical to the success of the disclosed game method. FIG. 1 shows a typical embodiment of one such spin wheel, with each letter and number combination being delineated in a given segment. The next letter and number combination is determined by an attached device that slows the rotation of the wheel until it is no longer spinning and a segment is chosen.

Referring now to FIG. 2, there is shown a view of a card component of the game method and kit that is provided to each player. Each Bingo style matrix card 12 includes a 5 by 5 matrix of squares 14. A row above the matrix of squares 14 places S above the first column, P above the second column, I above the third column, N above the fourth column and T above the fifth column. Within each of the individual square in the 5 by 5 matrix comprises a mathematical equation with an answer between 1 and 100. Each card supplied to the players includes different arithmetical problems that the user must solve in order to find the solution to that particular box. No two cards include the same set of equations or answer combinations.

The present invention is a math game that helps individuals understand basic mathematical and arithmetical concepts. The invention consists of a kit comprising a spinnable wheel or wheel with a spinnable element thereon 11 with the letters S, P, I, N and T and the numbers 1 through 100 provided in clear partitions. The wheel may be spun manually, or be mechanical or be provided as a computer program. Following a spin, the wheel 11 will indicate a letter and number combination. The kit also includes a plurality of Bingo style matrix cards 12. Each Bingo style matrix card 12 is labeled with a 5 by 5 matrix of squares 14, each filled with an equation or mathematical problem. A row above the matrix of squares 14 places S above the first column, P above the second column, I above the third column, N above the fourth column and T above the fifth column. The kit further includes chips 13 that are used to cover the squares on the card when an appropriate value is called, as in a traditional game of Bingo. The wheel 11 is divided into 100 pie style segments 13. Numbers are assigned to each segment 13. The first twenty segments 13 are labeled S1 through S20, the second twenty are labeled P21 through P40, the third twenty are labeled I41 through I60, the fourth twenty are labeled N61 through N80 and fifth twenty are labeled T81 through T100. The matrix of squares 14 on the cards will be filled with multiplication, addition, subtraction, and division equations. The answers to these equations will not exceed the numbers between 1 and 100.

In the present invention's method, the game is played by having a practitioner spin the wheel 11 and announce the letter/number combination segment 13 on which the wheel lands. Player practitioners check their cards to see if they have an equation that equals the called number in the called letter column of the matrix of squares 14. If so, the player practitioner covers that space with a chip. The player practitioner may only win if they have five chips in a row horizontally, vertically or diagonally. The player practitioner may then yell out "Spin-It" to have their cards verified to win the game.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kit for playing a mathematical learning game based on traditional Bingo, comprising:

a spinnable wheel divided into 100 pie style segments labeled S1 through S20, P21 through P40, 141 through I60, N61 through N80,T81 through T100 wherein segments beginning with the same alphabetical character are grouped together in contiguous alignment, thereby forming five adjacent sectors around said wheel, each sector containing 20 segments associated with an alphabetical character;

a plurality of cards each with a 5 by 5 matrix of squares comprising rows and columns, in which each square is filled with a mathematical equation, and said columns are labeled S,P,I,N and T respectively from left to right;

a plurality of chips to cover said equation filled squares;

and instructions detailing one or more methods of play.

2. A kit as in claim 1, wherein said spinnable wheel comprises a spinnable circular structure and a device for slowing its spin until a letter and number combination is settled upon.

3. A kit as in claim 1, wherein said spinnable wheel comprises a static wheel with a spinnable element thereon for determining a letter and number combination.

4. A method for mathematical learning based on traditional Bingo, comprising the steps of:

a caller practitioner spinning a wheel that comprises combinations of the letters S,P,I,N, and T, and the numbers 1 through 100 wherein segments beginning with the same alphabetical character are grouped together in contiguous alignment, thereby forming five adjacent sectors around said wheel, each sector containing 20 segments associated with an alphabetical character;

calling out a resulting indicated letter and number combination from said spun wheel;

player practitioners examining a 5 by 5 matrix of squares that comprises mathematical equations and column headers S,P,I,N and T said player practitioners covering a square in a particular column of said matrix corresponding to said equation solution that matches said indicated letter and number combination;

continuing to mark squares in the matrix for consecutive spins until said squares are covered to form a covered row, column or diagonal across said matrix card;

said player practitioner calling out "Spin-it!" to indicate a completed row, column or diagonal;

checking said player practitioner's matrix to verify victory.

* * * * *